US005439048A

United States Patent [19]

Osman et al.

[11] Patent Number: 5,439,048

[45] Date of Patent: Aug. 8, 1995

[54] FIXED REGENERATIVE HEAT EXCHANGER

[76] Inventors: Ramli B. Osman, 221 Boon Lay Place #05-106, Singapore 2264, Singapore; George Spector, 233 Broadway Rm 702, New York, N.Y. 10279

[21] Appl. No.: 243,163

[22] Filed: May 16, 1994

[51] Int. Cl.[6] ..... F23L 15/02; F28F 27/02

[52] U.S. Cl. ..... 165/4; 165/97

[58] Field of Search ..... 165/4, 9.2, 9.3, 97, 165/96, 66

[56] References Cited

U.S. PATENT DOCUMENTS

| | | | |
|---|---|---|---|
| 1,688,700 | 10/1928 | Gauss | 165/4 |
| 1,864,724 | 6/1932 | Forssblad | 165/4 |
| 3,225,819 | 12/1965 | Stevens | 165/4 |
| 3,656,542 | 4/1972 | Darm | 165/66 |

*Primary Examiner*—John Rivell
*Assistant Examiner*—Christopher Atkinson

[57] ABSTRACT

A fixed regenerative heat exchanger is provided, which consists of a heat exchange unit which is divided into two compartments, horizontally at both end sections and vertically at a middle section. A heat exchange matrix is housed in the middle section. Two sets of flow-switching dampers are also provided, with each set located between one end section and the middle section. In a first flow configuration, the two sets of dampers are arranged to allow hot air to flow through a left side of the middle section, while cold air flows through a right side of the middle section. In a second flow configuration, the two sets of dampers are arranged to allow hot air to flow through a right side of the middle section, while cold air flows through a left side of the middle section.

1 Claim, 1 Drawing Sheet

LEGEND:
VERTICAL PARTITION
CLOSED DAMPERS
HORIZONTAL PARTITION

COLD AIR OUT
HOT AIR IN
HOT AIR FLOW LINE
HOT AIR OUT
COLD AIR FLOW LINE
COLD AIR IN

COLD AIR OUT
HOT AIR IN
HOT AIR FLOW LINE
HOT AIR OUT
COLD AIR FLOW LINE
COLD AIR IN

COLD AIR OUT
MORE HOT AIR IN
HOT AIR OUT
MORE COLD AIR IN

FIXED REGENERATIVE HEAT EXCHANGER

BACKGROUND OF THE INVENTION

The instant invention relates generally to heat exchanges and more specifically it relates to a fixed regenerative heat exchanger, which provides a heat exchange unit divided into two compartments, horizontal at both end sections and vertical at a middle section with a heat exchange matrix.

There are available various conventional heat exchangers which do not provide the novel improvements of the invention herein disclosed.

SUMMARY OF THE INVENTION

A primary object of the present invention is to provide a fixed regenerative heat exchanger that will overcome the shortcomings of the prior art devices.

Another object is to provide a fixed regenerative heat exchanger that consists of a heat exchange unit, which is divided into two compartments, horizontal at both end sections and vertical at a middle section which houses a heat exchange matrix.

An additional object is to provide a fixed regenerative heat exchanger in which the intended application is for energy recovery in air conditioning and other situations, wherein exchange of heat between two flowing gas streams is to be effected.

A further object is to provide a fixed regenerative heat exchanger that is simple and easy to use.

A still further object is to provide a fixed regenerative heat exchanger that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4:
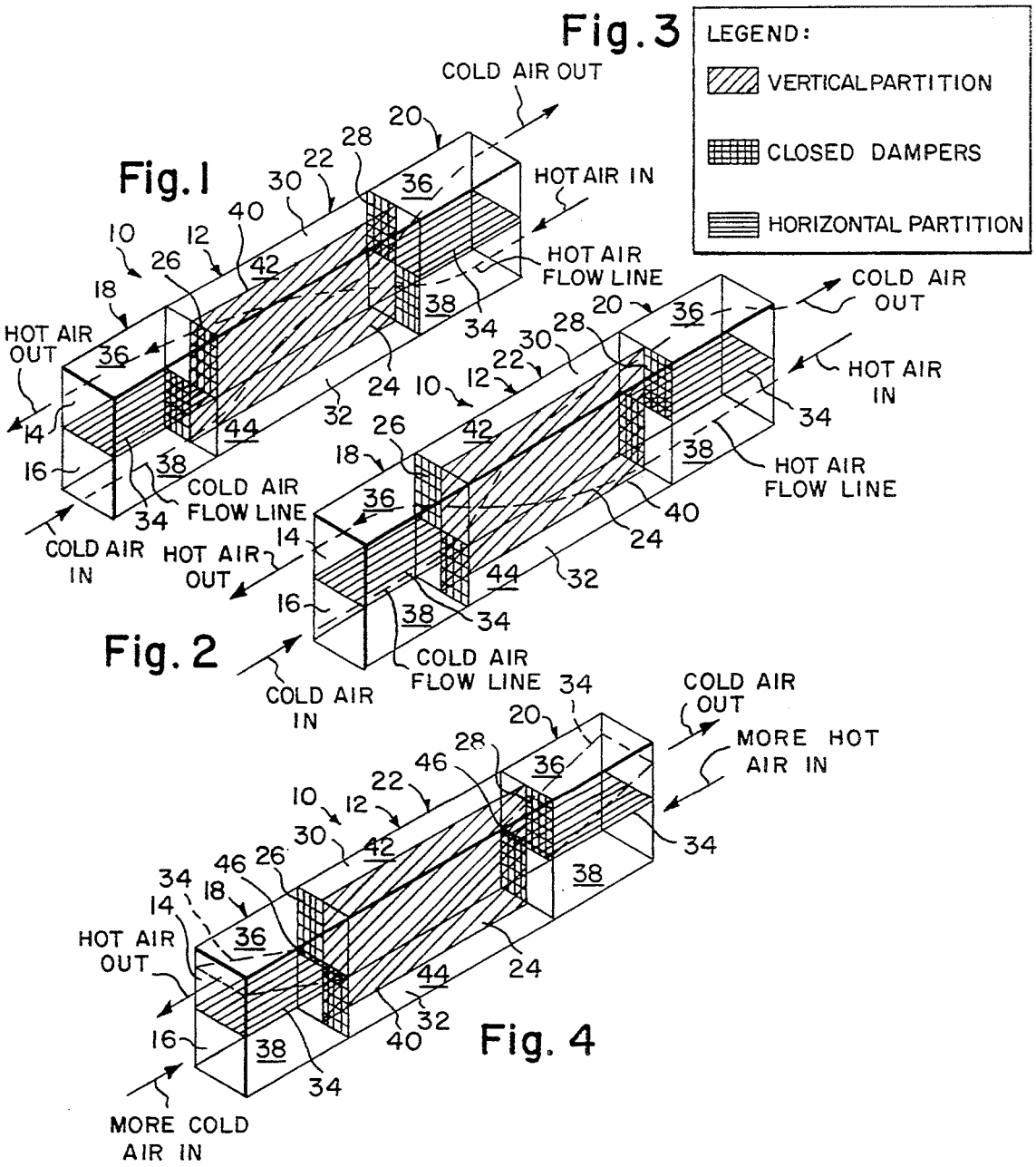
FIG. 1 is a diagrammatic perspective view of the instant invention showing a first flow configuration.
FIG. 2 is a diagrammatic perspective view, showing a second flow configuration.
FIG. 3 is a legend indicating various operating features.
FIG. 4 is a diagrammatic perspective view similar to FIG. 2, showing a modification in which the horizontal partitions are pivotable to adjust the cold air intake and the hot air intake.

Turning now descriptively to the drawings, in which similar reference characters denote similar elements throughout the several views, FIGS. 1 and 2 illustrate a fixed regenerative heat exchanger 10, which consists of a heat exchange unit 12 which is divided into two compartments 14, 16, horizontally at both end sections 18, 20 and vertically at a middle section 22. A heat exchange matrix 24 is housed in the middle section 22. Two sets of flow-switching dampers 26, 28 are provided, with each set located between one end section 18, 20 and the middle section 22.

In a first flow configuration, as shown in FIG. 1, the two sets of dampers 26, 28 are arranged to allow hot air to flow through a left side 30 of the middle section 22, while cold air flows through a right side 32 of the middle section 22. In a second flow configuration, as shown in FIG. 2, the two sets of dampers 26, 28 are arranged to allow hot air to flow through a right side 32 of the middle section 22, while cold air flows through a left side 30 of the middle section 22.

Each end section 18, 20 includes a horizontal partition 34, to divide it into two horizontal compartments 36, 38. The middle section 22 contains a vertical partition 40, to divide it into two vertical compartments 42, 44 with the heat exchange matrix 24 housed on both sides of the vertical partition 36.

In FIG. 4, the horizontal partitions 34 each includes a hinge 46 located at one side at the respective dampers 26, 28. The horizontal partitions 34 can be pivotable to adjust the cold air intake and the hot air intake.

OPERATION OF THE INVENTION

To use the fixed regenerative heat exchanger 10, the dampers 26 and 28 are moved by timer-controlled actuators (not shown), to alternate between the first flow configuration, as shown in FIG. 1 and the second flow configuration, as shown in FIG. 2. This will switch the hot air flow and the cold air flow to opposite sides of the vertical partition 40 with the heat exchange matrix 24. In FIG. 4, the horizontal partitions 34 can be adjusted to vary the cold air intake and the hot air intake.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fixed regenerative heat exchanger which comprises:

a) a heat exchanger unit which is divided into two compartments, horizontally at both end sections and vertically at a middle section;

b) a heat exchange matrix housed in said middle section and c) two sets of flow-switching dampers, each said set located between one said end section and said middle section, so that in a first flow configuration, said two sets of dampers are arranged to allow hot air to flow through a left side of said middle section, while cold air flows through a right side of said middle section and in a second flow configuration, said two sets of dampers are arranged to allow hot air to flow through a right side of said middle section, while cold air flows through a left side of said middle section; wherein each said end section includes a horizontal partition to divide it into two horizontal compartments; and wherein said middle section includes a vertical partition to divide it into two vertical compartments with said heat exchange matrix housed on both sides of said vertical partition and further wherein said horizontal partitions each include a hinge located at one side at said respective dampers, so that said horizontal partitions can be pivotable to adjust the cold air intake and the hot air intake.

* * * * *